US010297967B2

(12) United States Patent
Wei et al.

(10) Patent No.: US 10,297,967 B2
(45) Date of Patent: May 21, 2019

(54) ROTATABLE SOCKET DEVICE AND SOCKET MODULE THEREOF

(71) Applicant: POWERTECH INDUSTRIAL CO., LTD., New Taipei (TW)

(72) Inventors: Chia-Cheng Wei, New Taipei (TW); Jung-Hui Hsu, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 16/053,857

(22) Filed: Aug. 3, 2018

(65) Prior Publication Data

US 2019/0044295 A1 Feb. 7, 2019

(30) Foreign Application Priority Data

Aug. 7, 2017 (TW) ..... 106126575 A

(51) Int. Cl.
*H01R 31/06* (2006.01)
*H01R 35/04* (2006.01)

(52) U.S. Cl.
CPC ..... *H01R 35/04* (2013.01); *H01R 31/06* (2013.01)

(58) Field of Classification Search
CPC ..... H01R 35/00; H01R 35/04; H01R 31/06
See application file for complete search history.

(56) References Cited

U.S. PATENT DOCUMENTS 6,302,743 B1 * 10/2001 Chiu ..... H01R 25/003 439/22
6,638,074 B1 * 10/2003 Fisher ..... H01R 35/04 439/18
7,214,102 B2 * 5/2007 Chong ..... H01R 35/04 439/173
7,500,854 B2 * 3/2009 Gottstein ..... H01R 25/006 439/13
8,142,199 B1 * 3/2012 Almouli ..... H01R 25/142 439/10
8,747,119 B2 * 6/2014 Hsu ..... H01R 39/64 439/13
9,028,274 B2 * 5/2015 Zien ..... H01R 13/514 439/527
9,716,362 B2 * 7/2017 Liang ..... H01R 35/04
10,033,144 B1 * 7/2018 Patterson ..... H01R 25/006
2006/0110947 A1 * 5/2006 Gerard ..... H01R 35/04 439/21

* cited by examiner

*Primary Examiner* — Briggitte R. Hammond
(74) *Attorney, Agent, or Firm* — Li & Cai Intellectual Property (USA) Office

(57) ABSTRACT

A socket module of a rotatable socket device includes a first conductor, a second conductor, an insulator that is arranged to separate the first conductor from the second conductor, and a plurality of terminal sets. The first conductor includes a first base and a plurality of central rods connected to the first base. The second conductor includes a second base and a plurality of tubes connected to the second base. The tubes are respectively sleeved around the central rods. Each of the central rods and the corresponding tube are separated from each other by the insulator. The terminal sets are respectively rotatable along the central rods within a range of 360 degrees. Each of the terminal sets includes a first terminal rotatably contacting the corresponding central rod and a second terminal rotatably contacting the tube that is sleeved around the corresponding central rod.

10 Claims, 11 Drawing Sheets

ROTATABLE SOCKET DEVICE AND SOCKET MODULE THEREOF

CROSS-REFERENCE TO RELATED PATENT APPLICATION

This application claims the benefit of priority to Taiwan Patent Application No. 106126575, filed on Aug. 7, 2017. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a socket device, and more particularly to a rotatable socket device and a socket module thereof.

BACKGROUND OF THE DISCLOSURE

A conventional rotatable socket device includes a plurality of terminal sets that are connected to a plurality of cables, so that the inner configuration of the conventional rotatable socket device is disorderly, and the cables may affect the rotation of the conventional rotatable socket device. Moreover, if the conventional rotatable socket device includes a plurality of sockets, since each of the sockets needs to be connected with a plurality of cables, the inner configuration of the conventional rotatable socket device would be even more disorderly.

SUMMARY OF THE DISCLOSURE

In response to the above-referenced technical inadequacies, the present disclosure provides a rotatable socket device and a socket module thereof to effectively improve the issues associated with conventional rotatable socket devices.

In one aspect, the present disclosure provides a rotatable socket device, which includes an outer casing, a socket module, and a plurality of rotating casings. The socket module is installed in the outer casing and includes a first conductor, a second conductor, an insulator, and a plurality of terminal sets. The first conductor includes a first base and a plurality of central rods connected to the first base. Each of the central rods has an extending segment arranged adjacent to the first base and an exposed segment arranged away from the first base. The second conductor includes a second base and a plurality of tubes connected to the second base. The second conductor is spaced apart from the first conductor, and the tubes are respectively sleeved around the extending segments of the central rods. The insulator is arranged to separate the first base from the second base. Each of the extending segments and the corresponding tube are separated from each other by the insulator. The terminal sets are respectively rotatable along the central rods within a range of 360 degrees. Each of the terminal sets includes a first terminal rotatably contacting the exposed segment of the corresponding central rod and a second terminal rotatably contacting the tube that is sleeved around the corresponding central rod. The rotatable casings are installed in the outer casing and respectively fix the terminal sets in position, so that when each of the rotatable casings is rotated with respect to the outer casing, a relative position between the first terminal and the second terminal of the corresponding terminal set is maintained.

In one aspect, the present disclosure provides a socket module of a rotatable socket device. The socket module includes a first conductor, a second conductor, an insulator, and a plurality of terminal sets. The first conductor includes a first base and a plurality of central rods connected to the first base. Each of the central rods has an extending segment arranged adjacent to the first base and an exposed segment arranged away from the first base. The second conductor includes a second base and a plurality of tubes connected to the second base. The second conductor is spaced apart from the first conductor, and the tubes are respectively sleeved around the extending segments of the central rods. The insulator is arranged to separate the first base from the second base. Each of the extending segments and the corresponding tube are separated from each other by the insulator. The terminal sets are respectively rotatable along the central rods within a range of 360 degrees. Each of the terminal sets includes a first terminal rotatably contacting the exposed segment of the corresponding central rod and a second terminal rotatably contacting the tube that is sleeved around the corresponding central rod.

Therefore, the rotatable socket device and the socket module of the present disclosure each have the first conductor and the second conductor with specific structures, so that the first terminal and the second terminal of each of the terminal sets are rotatable along the same central rod within a range of 360 degrees. Moreover, each of the first conductor and the second conductor can be configured to connect to a single cable, so that the rotation of the rotatable socket device having a plurality of terminal sets can be operated smoothly.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
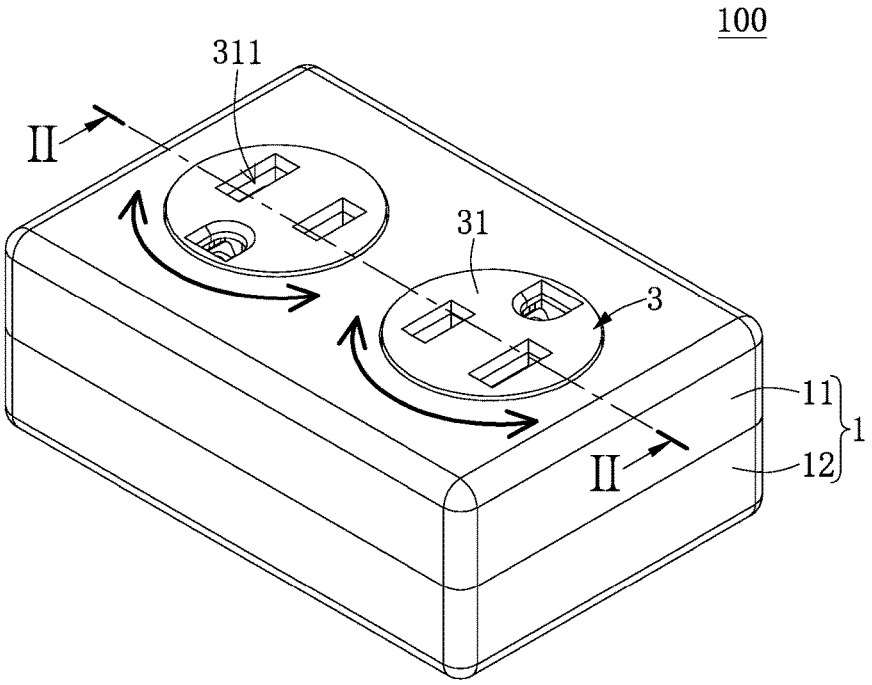
FIG. 1 is a perspective view of a rotatable socket device according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 10, a first embodiment of the present disclosure provides a rotatable socket device 100. As shown in FIG. 1 to FIG. 4, the rotatable socket device 100 of the present disclosure can be inserted with a plurality of plugs (not shown). The rotatable socket device 100 in the present embodiment is configured to be inserted with two plugs, but the present disclosure is not limited thereto.

The rotatable socket device 100 includes an outer casing 1, a socket module 2 installed in the outer casing 1, and a plurality of rotatable casings 3 installed in the outer casing 1. The outer casing 1 in the present embodiment includes a top casing 11 and a bottom casing 12, but the present disclosure is not limited thereto.

As shown in FIG. 5 to FIG. 8, the socket module 2 includes a first conductor 21, an insulator 22, a second conductor 23 spaced apart from the first conductor 21, a third conductor 24, and a plurality of terminal sets 25. The first conductor 21, the second conductor 23, and the third conductor 24 are electrically isolated from each other. Each of the terminal sets 25 includes a first terminal 251 arranged to contact the first conductor 21, a second terminal 252 arranged to contact the second conductor 23, and a third terminal 253 arranged to contact the third conductor 24.

It should be noted that the terminal sets 25 are respectively arranged in and fixed with the rotatable casings 3, so that when each of the rotatable casings 3 is rotated with respect to the outer casing 1, a relative position between all terminals (e.g., the first terminal 251, the second terminal 252, and the third terminal 253) of the corresponding terminal set 25 can be maintained. Each of the rotatable casings 3 includes an upper casing 31 and a lower casing 32 fastened to the upper casing 31. A top surface of the upper casing 31 is substantially coplanar with that of the top casing 11 of the outer casing 1. Moreover, the upper casing 31 has a plurality of insert holes 311 that are formed in the top surface thereof and respectively correspond in position to the terminal sets 25, so that plugs (not shown) can be inserted into the insert holes 311 to respectively contact the terminal sets 25.

In addition, the socket module 2 in the present embodiment includes the first conductor 21, the second conductor 23, the third conductor 24, and the corresponding components, but the present disclosure is not limited thereto. For example, in other embodiments of the present disclosure, the socket module 2 can be provided without the third conductor 24. That is to say, the socket module 2 includes the first conductor 21, the second conductor 23, and the corresponding components (e.g., the insulator 22 and each of the terminal sets 25 that only has the first terminal 251 and the second terminal 252), and when each of the rotatable casings 3 is rotated with respect to the outer casing 1, a relative position between the first terminal 251 and the second terminal 252 of the corresponding terminal set 25 can be maintained.

Figure 6:
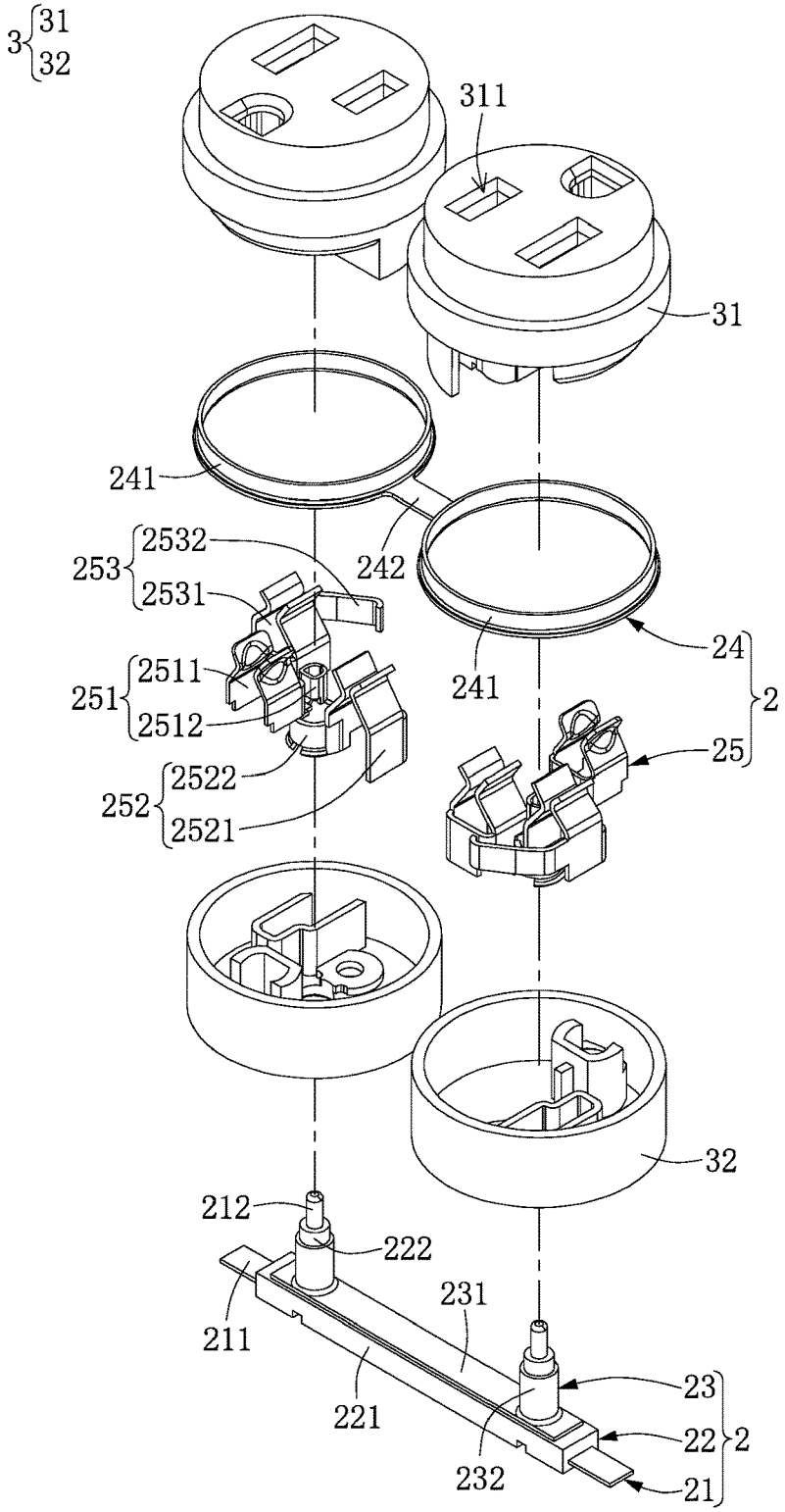
FIG. 6 is an exploded view of FIG. 5.
Figure 7:
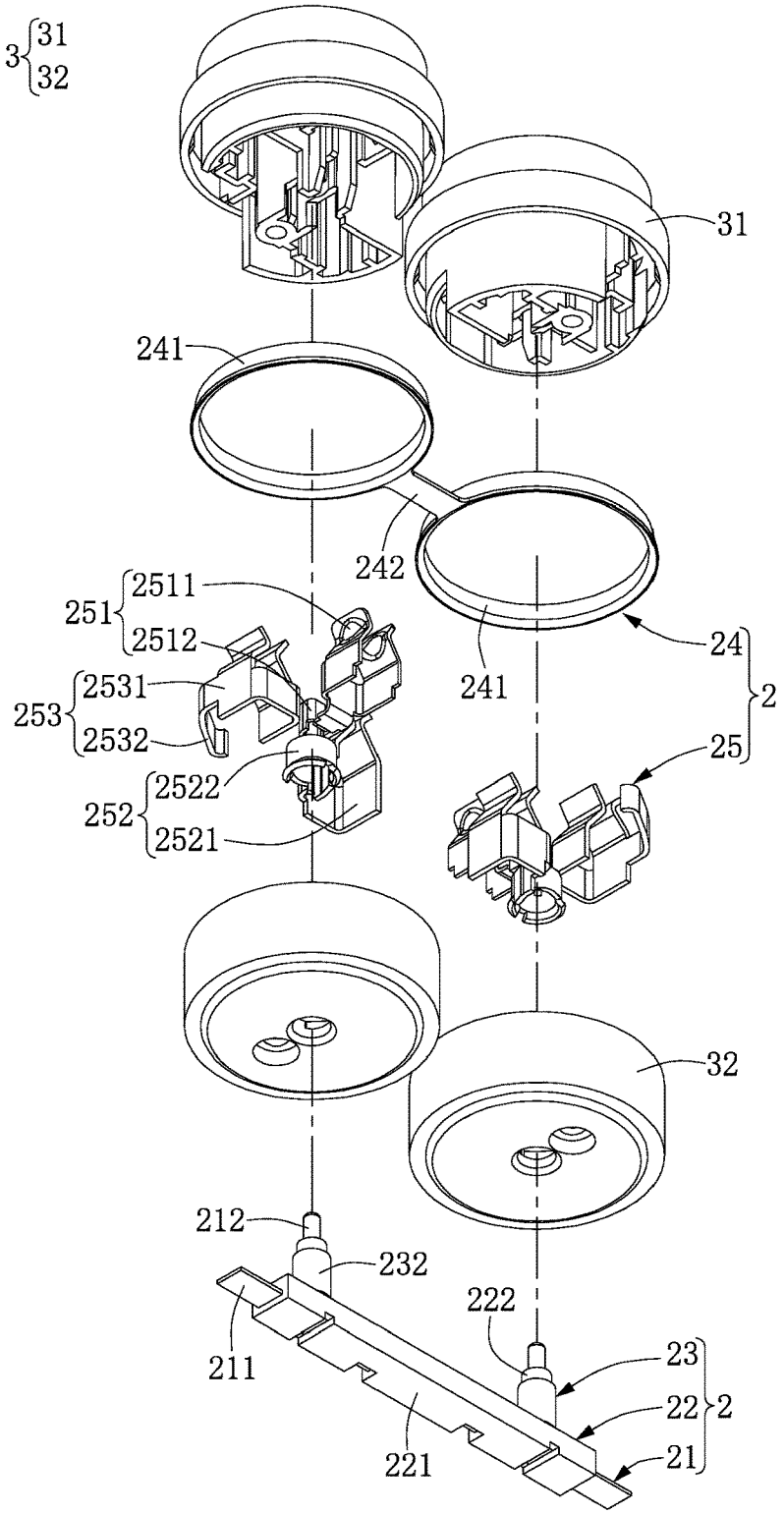
FIG. 7 is an exploded view of FIG. 5 from another perspective.
Figure 8:
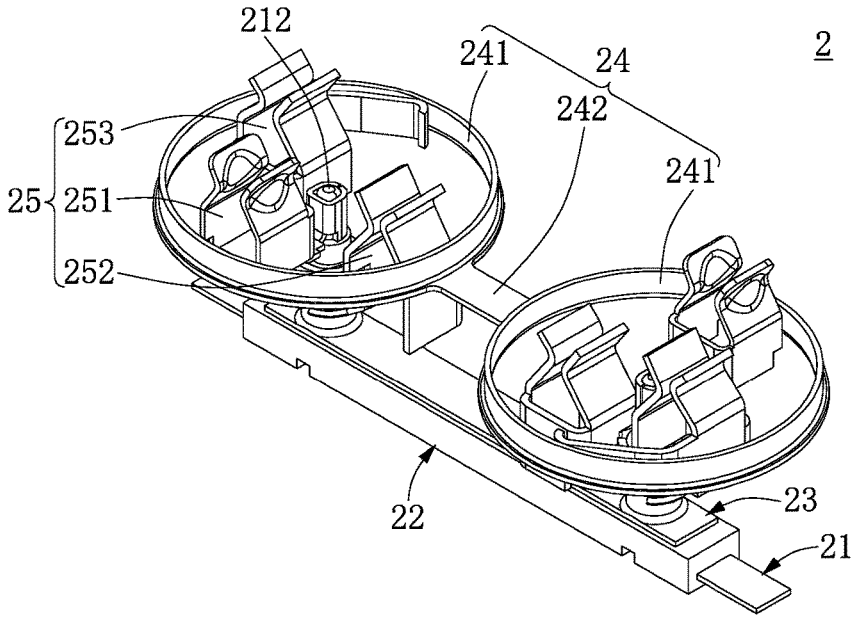
FIG. 8 is a perspective view showing the socket module according to the present disclosure.
Figure 9:
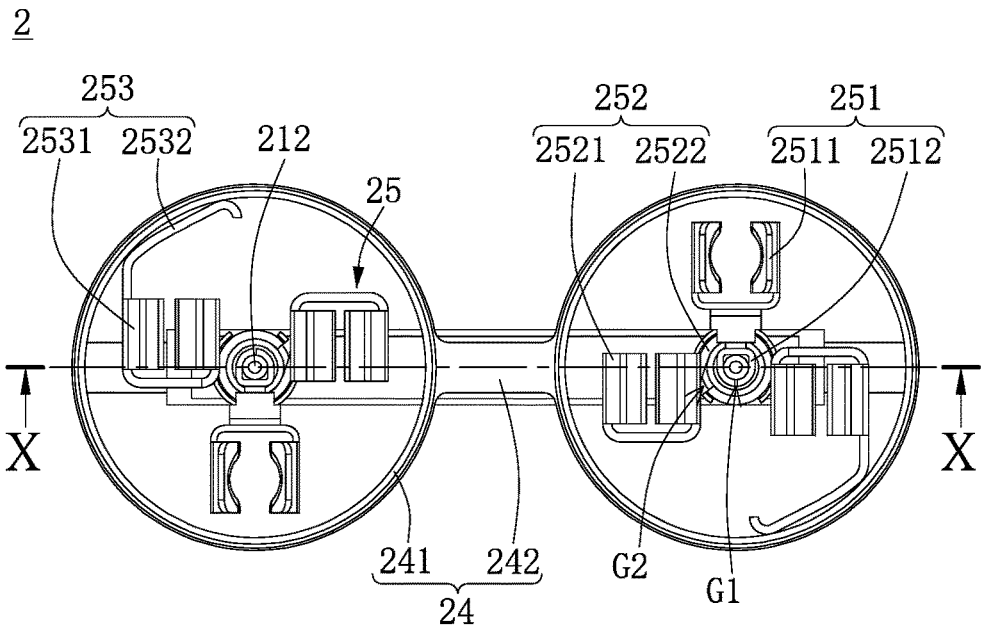
FIG. 9 is a top planar view of FIG. 8.
Figure 10:
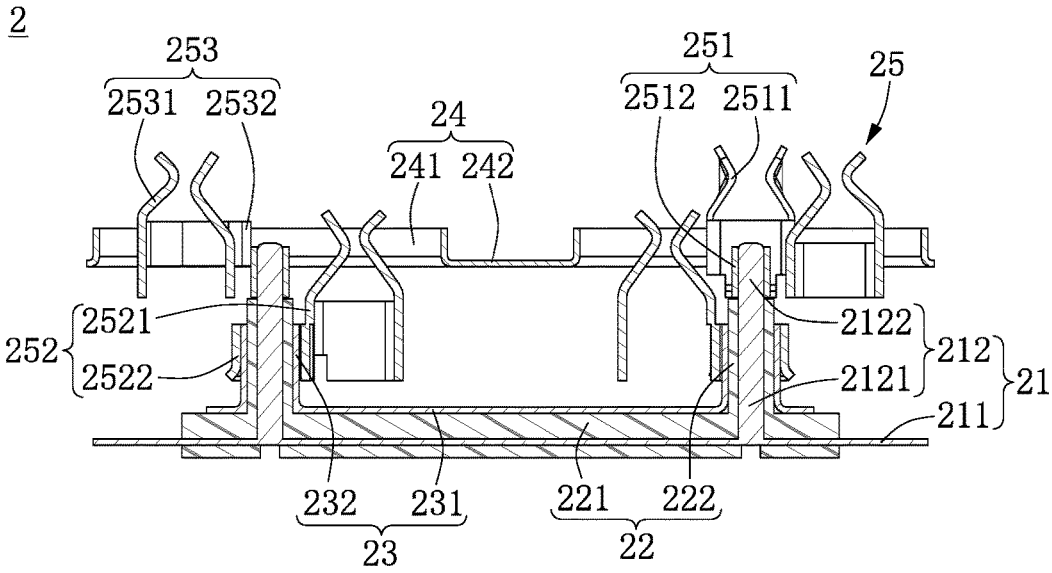
FIG. 10 is a cross-sectional view taken along line X-X of FIG. 9.

As shown in FIG. 6, FIG. 9, and FIG. 10, the first conductor 21 includes a first base 211 and a plurality of central rods 212 connected to the first base 211. In the present embodiment, an end of each of the central rods 212 is perpendicularly connected to the first base 211. The first base 211 of the present embodiment is in a straight shape. Each of the central rods 212 is in a cylindrical shape, and has an extending segment 2121 arranged adjacent to the first base 211 and an exposed segment 2122 arranged away from the first base 211. Moreover, the central rods 212 in the present embodiment are integrally connected to a side of the first base 211 (e.g., the top side of the first base 211 shown in FIG. 10).

In addition, the first conductor 21 of the present disclosure is not limited to FIG. 10. For example, in other embodiments of the present disclosure, the first base 211 can be in a non-straight shape (e.g., a U-shape, a polygonal shape, or a circular shape); each of the central rods 212 can be fixed on the first base 211 by soldering or screwing; a portion of each of the central rods 212 connected to the first base 211 can be other than the end of each of the central rods 212; the central rods 212 can be respectively connected to two opposite sides of the first base 211; and the central rod 212 can be a circular tube.

As shown in FIG. 6, FIG. 9, and FIG. 10, the insulator 22 is arranged to separate the first conductor 21 from the second conductor 23. The insulator 22 in the present embodiment covers (or is attached to) at least part of the first conductor 21, and the exposed segment 2122 of each of the central rods 212 protrudes from the insulator 22. Specifically, the insulator 22 includes a first segment 221 and a plurality of second segments 222 extending from the first segment 221. The first segment 221 covers (or is attached to) at least part of the first base 211, and the other part of the first base 211 not covered by the first segment 221 can be configured to connect to a single cable (not shown). The second segments 222 respectively cover (or are attached to) the extending segments 2121 of the central rods 212. In other words, a portion of the central rod 212 covered by the second segment 222 is defined as the extending segment 2121. The exposed segment 2122 of each of the central rods 212 protrudes from the corresponding second segment 222.

In addition, the insulator 22 in the present embodiment covers the first conductor 21 so as to electrically isolate the first conductor 21 from the second conductor 23, but the present disclosure is not limited thereto. For example, in other embodiments of the present disclosure, the insulator 22 can cover the second conductor 23 to electrically isolate the second conductor 23 from the first conductor 21, or portions of the first conductor 21 and the second conductor 23 facing each other can be separated from each other by the insulator 22, and the other portions of the first conductor 21 and the second conductor 23 can be electrically isolated from each other by air.

As shown in FIG. 6, FIG. 9, and FIG. 10, the second conductor 23 includes a second base 231 and a plurality of tubes 232 connected to the second base 231. Each of the tubes 232 in the present embodiment is integrally and perpendicularly connected to the second base 231. The second base 231 is in a straight shape that is parallel to the first base 211, and is configured to connect to a single cable (not shown). The second base 231 is disposed on the first segment 221 of the insulator 22, so that the first base 211 and the second base 231 can be separate from each other through the insulator 22. The tubes 232 are respectively sleeved around/on the second segments 222. In other words, the tubes 232 are respectively sleeved around the extending segments 2121 of the central rods 212, and each of the tubes 232 and the sleeved extending segment 2121 are separate from each other through the insulator 22.

Figure 2:
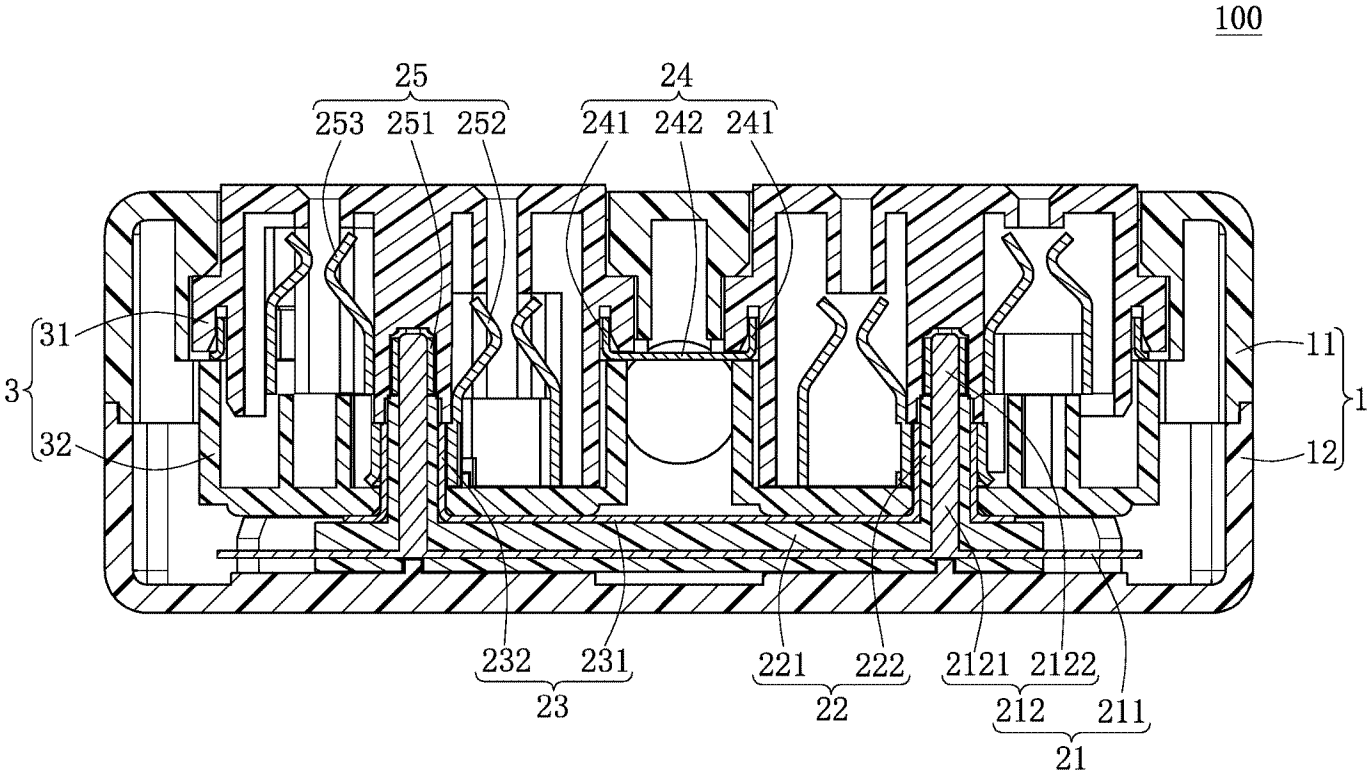
FIG. 2 is a cross-sectional view taken along line II-II of FIG. 1.
Figure 3:
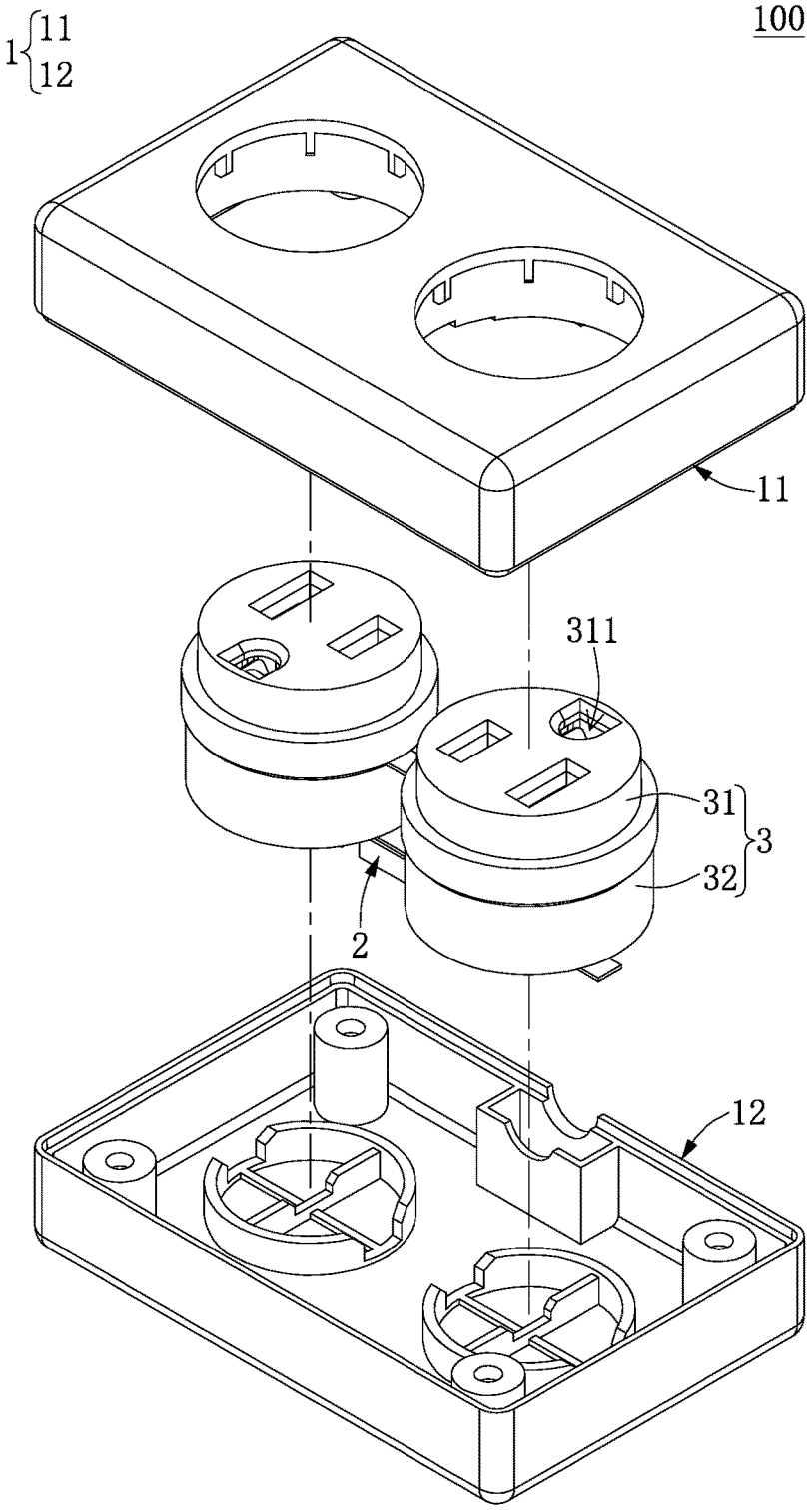
FIG. 3 is an exploded view of FIG. 1.
Figure 4:
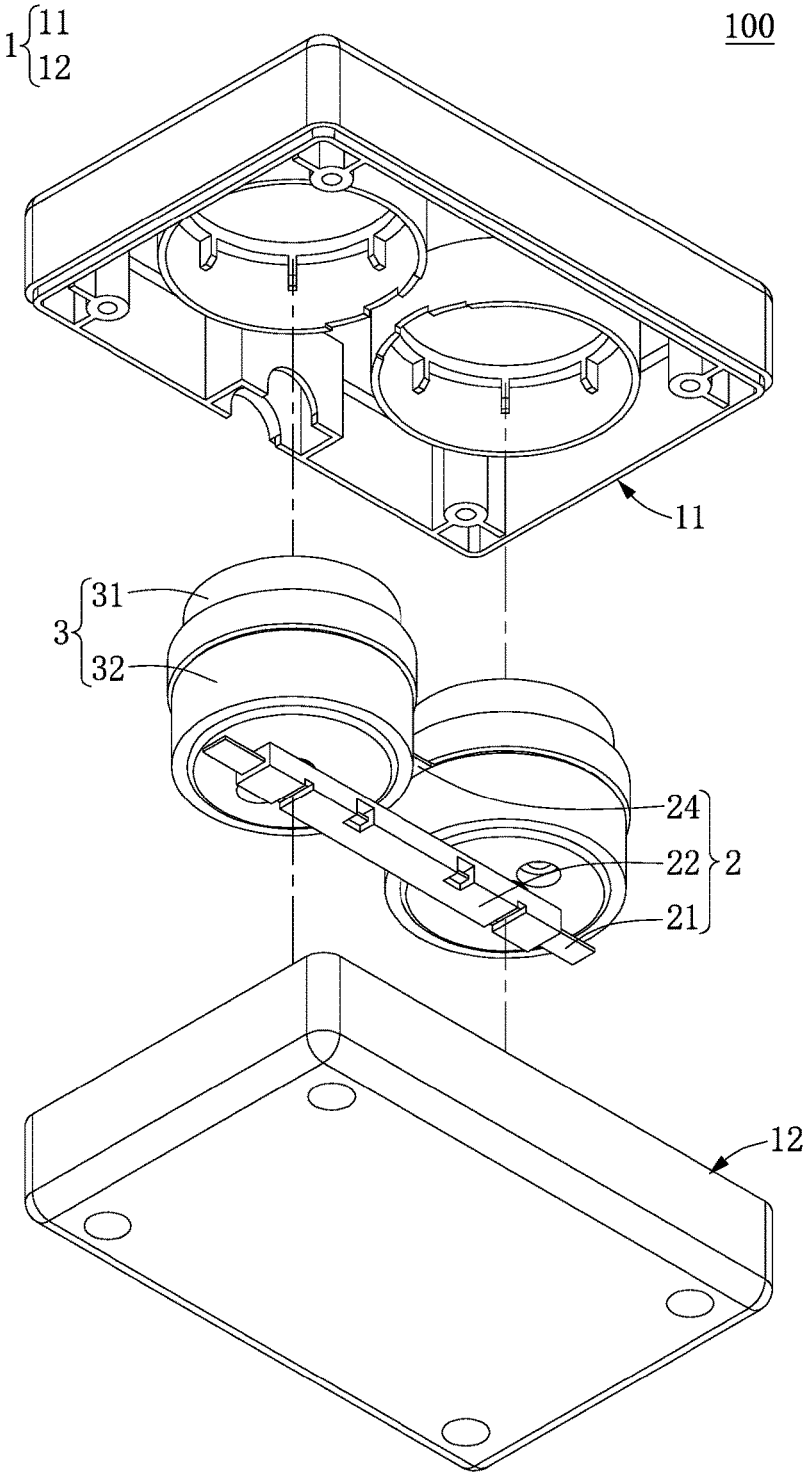
FIG. 4 is an exploded view of FIG. 1 from another perspective.
Figure 5:
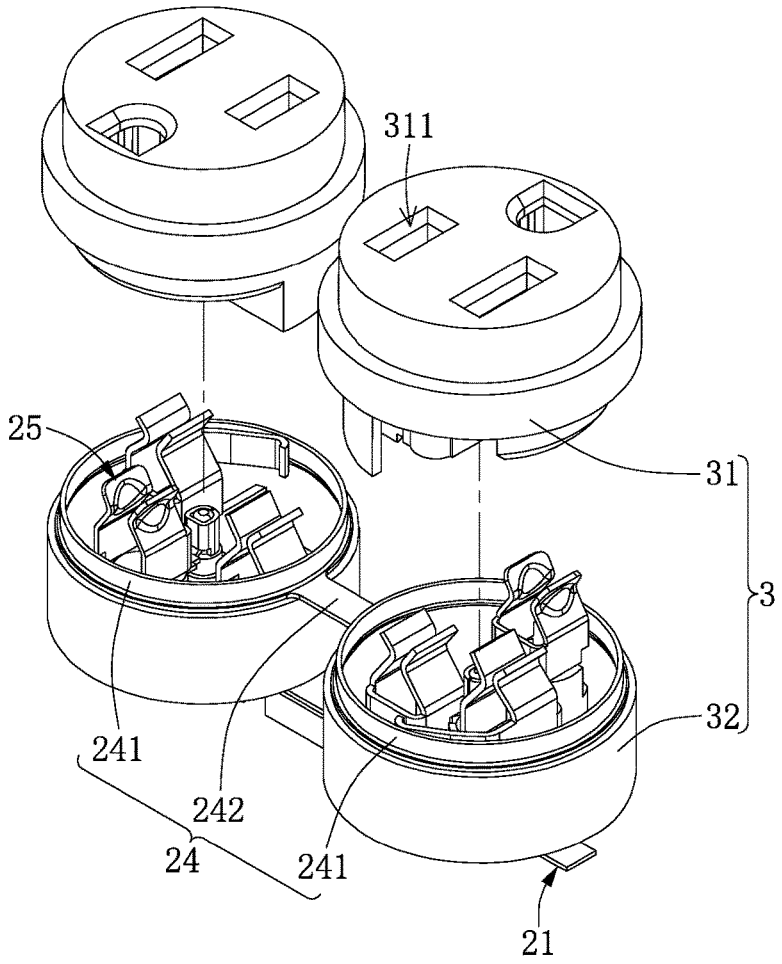
FIG. 5 is a perspective view showing a socket module and a rotatable casing of the rotatable socket device according to the present disclosure.

Moreover, as shown in FIG. 2, the first conductor 21 is positioned on an inner surface of the bottom casing 12 of the outer casing 1 through the insulator 22, the lower casing 32 of each of the rotatable casings 3 is disposed on the second base 231, and each of the central rods 212, the corresponding second segment 222 of the insulator 22, and the corresponding tube 232 are inserted into one of the rotatable casings 3. In other words, the first base 211, the second base 231, and the first segment 221 of the socket module 2 are arranged outside of the rotatable casings 3.

In addition, if the structure of the first conductor 21 is changed, the structure of the second conductor 23 can be adjusted according to the changed first conductor 21 so that the tubes 232 can remain sleeved around the extending segments 2121 of the central rods 212, respectively. Moreover, each of the tubes 232 can be fixed on the second base 231 by soldering or screwing.

As shown in FIG. 6, FIG. 9, and FIG. 10, the third conductor 24 includes a plurality of circular rings 241 and at least one connecting segment 242 that connects the circular rings 241. Moreover, centers of the circular rings 241 are respectively arranged at the central rods 212, and the circular rings 241 are respectively fixed on the rotatable casings 3. Each of the circular rings 241 in the present embodiment is sandwiched between the upper casing 31 and the lower casing 32 of the corresponding rotatable casing 3. The connecting segment 242 is not only formed to connect the circular rings 241, but also used to connect to a single cable (not shown).

The connection between the two adjacent circular rings 241 in the present embodiment is established through the connecting segment 242 connected to closest portions thereof, but the present disclosure is not limited thereto. For example, in other embodiments of the present disclosure, the connecting segment 242 can be arranged in an external tangent defined by the circular rings 241, and can be formed to connect at least two of the circular rings 241.

As shown in FIG. 6, FIG. 9, and FIG. 10, the terminal sets 25 are respectively arranged inside of the circular rings 241 of the third conductor 24, and the terminal sets 25 are respectively rotatable along the central rods 212 of the first conductor 21 within a range of 360 degrees. As the terminal sets 25 in the present embodiment are of the same structure, the following description discloses the structure of just one of the terminal sets 25 and the corresponding components (e.g., the central rod 212, the tube 232, and the circular ring 241) for the sake of brevity.

The first terminal 251 is configured to rotatably contact the exposed segment 2122 of the central rod 212, the second terminal 252 is configured to rotatably contact the tube 232 that is sleeved around the central rod 212, and the third terminal 253 is configured to detachably contact an inner surface of the circular ring 241.

Specifically, the first terminal 251 includes a first insert portion 2511 and a first contacting portion 2512 connected to the first insert portion 2511. The first insert portion 2511 is inserted with a corresponding terminal of plug. The exposed segment 2122 of the central rod 212 is inserted into the first contacting portion 2512, and the first contacting portion 2512 is positioned with and in contact with the exposed segment 2122 of the central rod 212. The first contacting portions 2512 is formed with a gap G1 so as to have a substantial C-shaped section (as shown in FIG. 9) that is perpendicular to the central rod 212.

Moreover, the second terminal 252 includes a second insert portion 2521 and a second contacting portion 2522 connected to the second insert portion 2521. The second insert portion 2521 is inserted with a corresponding terminal of plug. The tube 232 is inserted into the second contacting portion 2522, and the second contacting portion 2522 is positioned with and in contact with the tube 232. The second contacting portions 2522 is formed with a gap G2 so as to have a substantial C-shaped section (as shown in FIG. 9) that is perpendicular to the central rod 212.

The third terminal 253 includes a third insert portion 2531 and a third contacting portion 2532 connected to the third insert portion 2531. The third insert portion 2531 is inserted with a corresponding terminal of plug. The third contacting portion 2532 is an elastic arm, and is abutted against the inner surface of the circular ring 241. Moreover, the relative position between the third contacting portion 2532 and the circular ring 241 is maintained by the cooperation of the third terminal 253 and the rotatable casing 3.

In addition, the relationship between the first terminal 251 and the central rod 212 in the present embodiment is established by using the first contacting portion 2512 to be fixed in position with and in contact with the exposed segment 2122, but the present disclosure is not limited thereto. For example, in other embodiments of the present disclosure, the first contacting portion 2512 can only be contact with the exposed segment 2122, and the first terminal 251 can be positioned with the central rod 212 by the cooperation of the first terminal 251 and the rotatable casing 3.

Similarly, the relationship between the second terminal 252 and the tube 232 in the present embodiment is established by using the second contacting portion 2522 to be fixed in position with and in contact with the tube 232, but the present disclosure is not limited thereto. For example, in other embodiments of the present disclosure, the second contacting portion 2522 can only be in contact with the tube 232, and the second terminal 252 is positioned with the tube 232 by the cooperation of the second terminal 252 and the rotatable casing 3.

Second Embodiment

Figure 11:
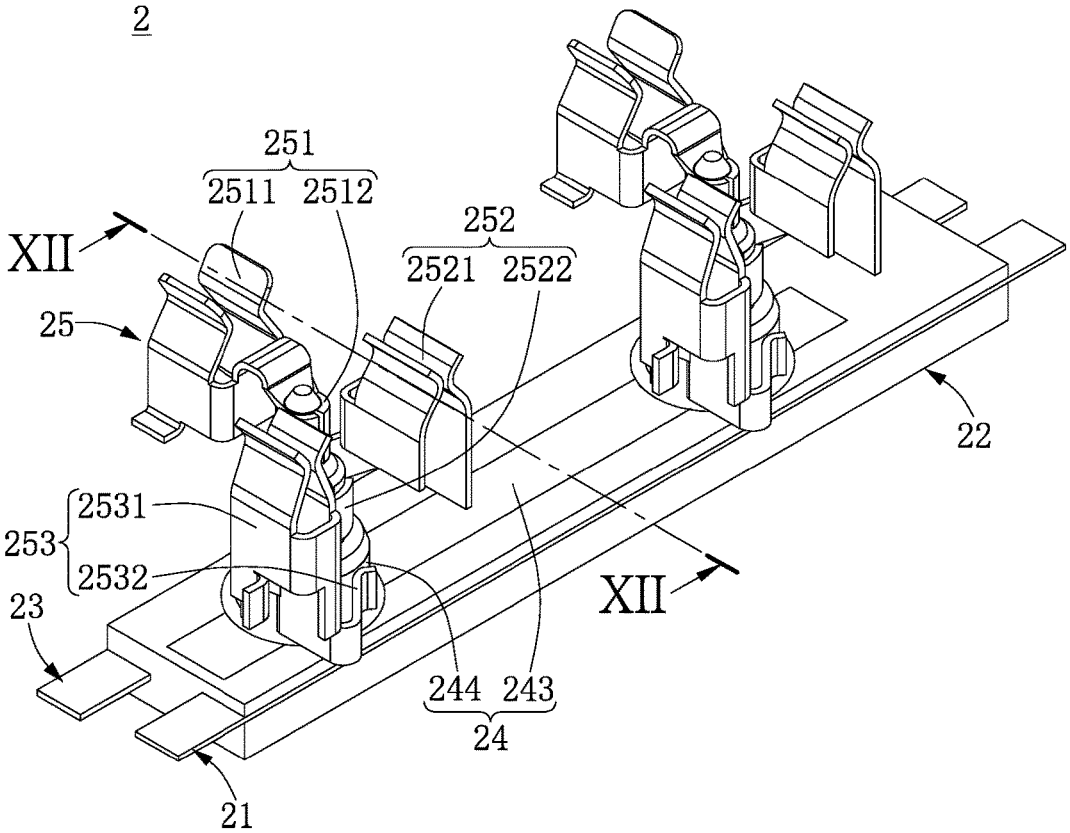
FIG. 11 is a cross-sectional view showing the rotatable socket device in another configuration.
Figure 12:
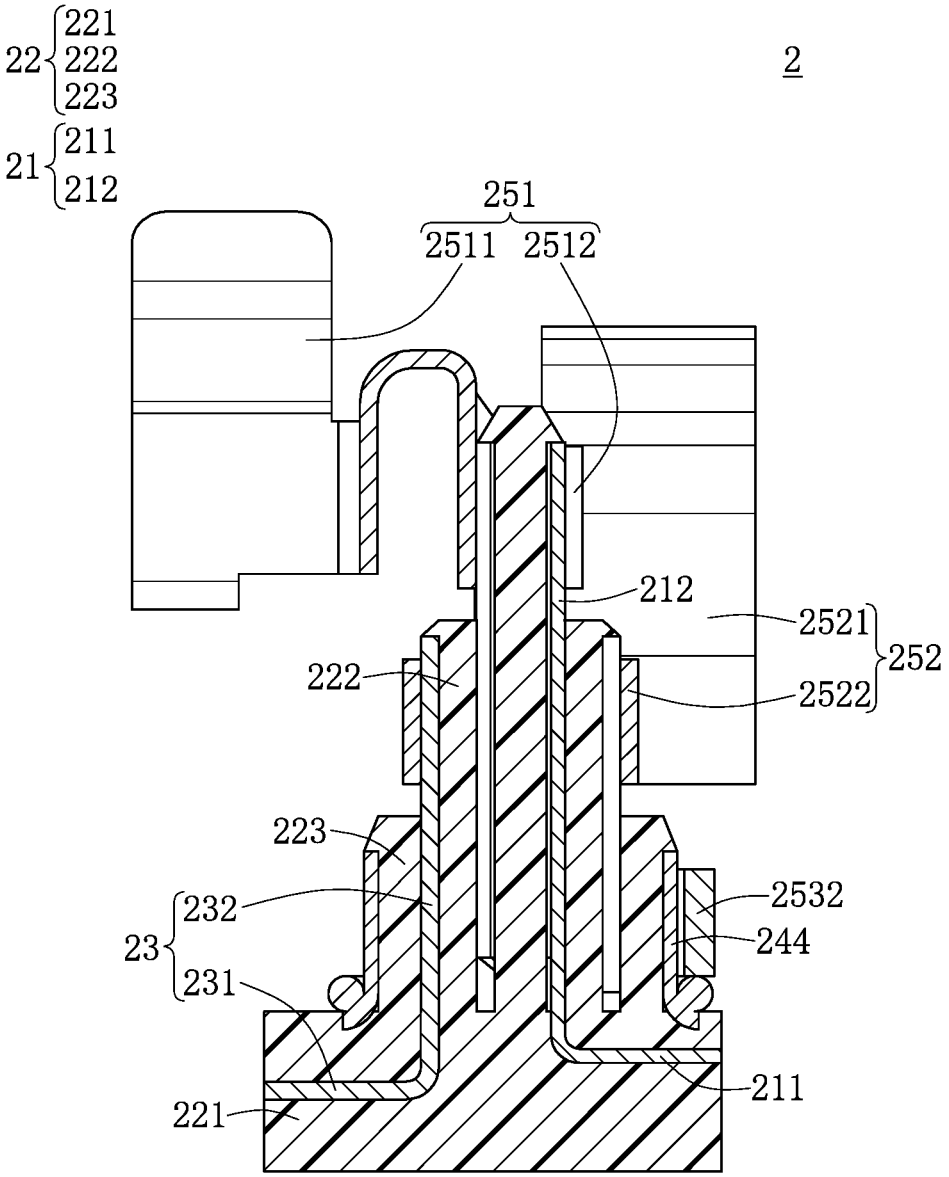
FIG. 12 is a cross-sectional view taken along line X II -X II of FIG. 11.

Referring to FIG. 11 and FIG. 12, a second embodiment of the present disclosure provides a rotatable socket device 100. The present embodiment is similar to the first embodiment, and the difference between the two embodiments resides in the socket module 2.

Specifically, the insulator 22 is arranged to separate the first conductor 21, the second conductor 23, and the third conductor 24 from each other. The insulator 22 includes a first segment 221, a plurality of second segments 222 extending from the first segment 221, and a plurality of third segments 223 extending from the first segment 221. The first segment 221 and the second segments 222 of the present embodiment are similar to that of the first embodiment.

The third segments 223 are respectively arranged outside of the second segments 222, and a height of each of the third segments 223 with respect to the first segment 221 is lower than a height of the corresponding second segment 222 with respect to the first segment 221. More specifically, the third segments 223 respectively cover bottom portions of the tubes 232 of the second conductors 23, and a top portion of each of the tubes 232 protrudes from the corresponding third segment 223 of the insulator 22.

The structure of the third conductor 24 of the present embodiment is different from that of the first embodiment. The third conductor 24 in the present embodiment includes a third base 243 having a straight shape and a plurality of hollow cylinders 244 connected to the third base 243, and each of the hollow cylinders 244 is preferably provided to be integrally and perpendicularly connected to the third base 243.

The third base 243 in the present embodiment is parallel to the first base 211, and is configured to connect to a single cable (not shown). The third base 243 is disposed on the first segment 221 of the insulator 22, so that the first base 211 and the second base 231 are separated from each other through the insulator 22. The hollow cylinders 244 are respectively sleeved around/on the third segments 223. In other words, the hollow cylinders 244 are respectively sleeved around bottom portions of the tubes 232, and each of the hollow cylinders 244 and the bottom portion of the corresponding tube 232 are separate from each other through the corresponding third segment 223 of the insulator 22.

The third insert portion 2531 of the third terminal 253 is inserted with a corresponding terminal of plug, and the third contacting portion 2532 is an elastic arm that is abutted against an outer surface of the hollow cylinder 244. Moreover, the relative position between the third contacting portion 2532 and the hollow cylinder 244 is maintained by the cooperation of the third terminal 253 and the rotatable casing 3, but the present disclosure is not limited thereto.

In conclusion, the rotatable socket device and the socket module of the present disclosure each have the first conductor and the second conductor with specific structures, so that the first terminal and the second terminal of each of the terminal sets are rotatable along the same central rod within a range of 360 degrees. Moreover, each of the first conductor and the second conductor can be formed to connect to a single cable, so that the rotation of the rotatable socket device having a plurality of terminal sets can be operated smoothly.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A rotatable socket device, comprising:

an outer casing;

a socket module installed in the outer casing and including:

a first conductor including a first base and a plurality of central rods connected to the first base, wherein each of the central rods has an extending segment arranged adjacent to the first base and an exposed segment arranged away from the first base;

a second conductor including a second base and a plurality of tubes connected to the second base, wherein the second conductor is spaced apart from the first conductor, and the tubes are respectively sleeved around the extending segments of the central rods;

an insulator arranged to separate the first base from the second base, wherein each of the extending segments and the corresponding tube are separated from each other by the insulator; and a plurality of terminal sets respectively rotatable along the central rods within a range of 360 degrees, wherein each of the terminal sets includes a first terminal rotatably contacting the exposed segment of the corresponding central rod and a second terminal rotatably contacting the tube that is sleeved around the corresponding central rod; and a plurality of rotatable casings installed in the outer casing and respectively fixing the terminal sets in position, so that when each of the rotatable casings is rotated with respect to the outer casing, a relative position between the first terminal and the second terminal of the corresponding terminal set is maintained.

2. The rotatable socket device according to claim 1, wherein the insulator covers at least part of the first conductor, and the exposed segment of each of the central rods protrudes from the insulator.

3. The rotatable socket device according to claim 2, wherein the insulator includes a first segment and a plurality of second segments extending from the first segment, the first segment covers at least part of the first base, the second base is disposed on the first segment, and a portion of the first base not covered by the first segment is configured to connect to a single cable; and the second segments respectively cover the extending segments of the central rods, and the tubes are respectively sleeved around the second segments.

4. The rotatable socket device according to claim 3, wherein the first base, the second base, and the first segment of the socket module are arranged outside of the rotatable casings.

5. The rotatable socket device according to claim 1, wherein the first terminal of each of the terminal sets includes a first insert portion and a first contacting portion connected to the first insert portion, and the exposed segments of the central rods are respectively inserted into the first contacting portions of the terminal sets; and the second terminal of each of the terminal sets includes a second insert portion and a second contacting portion connected to the second insert portion, and the tubes are respectively inserted into the second contacting portions of the terminal sets.

6. The rotatable socket device according to claim 5, wherein each of the first contacting portions is formed with a gap so as to have a substantial C-shaped section that is perpendicular to the corresponding central rod; and each of the second contacting portions is formed with a gap so as to have a substantial C-shaped section that is perpendicular to the corresponding central rod.

7. The rotatable socket device according to claim 1, wherein the socket module includes a third conductor, and the third conductor includes a plurality of circular rings and at least one connecting segment that connects the circular rings; centers of the circular rings are respectively arranged at the central rods, and the circular rings are respectively fixed on the rotatable casings; the terminal sets are respectively arranged inside of the circular rings, and each of the terminal sets includes a third terminal that contacts an inner surface of the corresponding circular ring; and when each of the rotatable casings is rotated with respect to the outer casing, a relative position between the first terminal, the second terminal, and the third terminal of the corresponding terminal set is maintained.

8. The rotatable socket device according to claim 7, wherein each of the rotatable casings includes an upper casing and a lower casing fastened to the upper casing, the lower casing of each of the rotatable casings is disposed on the second base, and each of the circular rings is sandwiched between the upper casing and the lower casing of the corresponding rotatable casing.

9. The rotatable socket device according to claim 1, wherein each of the first base and the second base is in a straight shape, the first base and the second base are parallel to each other, and the central rods are integrally connected to a side of the first base.

10. A socket module of a rotatable socket device, comprising:

a first conductor including a first base and a plurality of central rods connected to the first base, wherein each of the central rods has an extending segment arranged adjacent to the first base and an exposed segment arranged away from the first base;

a second conductor including a second base and a plurality of tubes connected to the second base, wherein the second conductor is spaced apart from the first conductor, and the tubes are respectively sleeved around the extending segments of the central rods;

an insulator arranged to separate the first base from the second base, wherein each of the extending segments and the corresponding tube are separated from each other by the insulator; and a plurality of terminal sets respectively rotatable along the central rods within a range of 360 degrees, wherein each of the terminal sets includes a first terminal rotatably contacting the exposed segment of the corresponding central rod and a second terminal rotatably contacting the tube that is sleeved around the corresponding central rod.

* * * * *